US009878826B2

(12) United States Patent
Gay

(10) Patent No.: US 9,878,826 B2
(45) Date of Patent: Jan. 30, 2018

(54) FLUID PROTECTION ASSEMBLY

(71) Applicant: Sheila F. Gay, Pascagoula, MS (US)

(72) Inventor: Sheila F. Gay, Pascagoula, MS (US)

( * ) Notice: Subject to any disclaimer, the term of this patent is extended or adjusted under 35 U.S.C. 154(b) by 301 days.

(21) Appl. No.: 14/699,312

(22) Filed: Apr. 29, 2015

(65) Prior Publication Data

US 2016/0318663 A1 Nov. 3, 2016

(51) Int. Cl.

| | |
|---|---|
| ***A47C 27/00*** | (2006.01) |
| ***B65D 30/10*** | (2006.01) |
| ***A47C 31/00*** | (2006.01) |
| ***A47C 31/11*** | (2006.01) |

(52) U.S. Cl.

CPC ..... *B65D 31/16* (2013.01); *A47C 31/00* (2013.01); *A47C 31/113* (2013.01)

(58) Field of Classification Search

CPC .... A47G 9/0253; A47C 27/002; A47C 31/10; A47C 31/11; A47C 21/022; B65D 31/16

USPC ..... 150/158, 154; 206/326, 223, 586, 525; 27/28; 190/1; 5/82 R

See application file for complete search history.

(56) References Cited

U.S. PATENT DOCUMENTS

| | | | | |
|---|---|---|---|---|
| 2,279,694 | A * | 4/1942 | Martinson | A61G 1/01 27/28 |
| 4,584,201 | A | 4/1986 | Boston | |
| 4,922,562 | A * | 5/1990 | Allred | A61G 1/013 128/870 |
| 5,614,311 | A | 3/1997 | Morita et al. | |
| 5,660,257 | A * | 8/1997 | Douglas | A45C 15/00 190/1 |
| 6,103,809 | A | 8/2000 | Ahmed et al. | |
| 7,232,858 | B2 | 6/2007 | Bonfanti et al. | |
| 2011/0011762 | A1* | 1/2011 | Hurst | B65D 33/2591 206/326 |
| 2011/0162178 | A1* | 7/2011 | Jensen | A61G 17/06 27/28 |
| 2013/0077897 | A1 | 3/2013 | Li | |
| 2014/0259577 | A1* | 9/2014 | Richardson | A61G 17/06 27/28 |

* cited by examiner

*Primary Examiner* — Fenn C Mathew
*Assistant Examiner* — Cynthia Collado

(57) ABSTRACT

A fluid protection assembly for includes a bag that has a top wall, a bottom wall, a first flap and a peripheral wall extending between the top wall and the bottom wall. The bottom wall may be positioned on a support surface and the bag may insertably receive an object when the first flap is positioned in an open position. The top wall is drawn upwardly and over the object such that the bag envelopes the object and the bag is comprised of a fluid impermeable material. A closure is attached to the bag and the closure closes the first flap. A plurality of first ties is coupled to the top wall. A plurality of second ties is coupled to the top wall and the second ties are tied to the first ties.

11 Claims, 4 Drawing Sheets

FLUID PROTECTION ASSEMBLY

BACKGROUND OF THE DISCLOSURE

Field of the Disclosure

The disclosure relates to protection devices and more particularly pertains to a new protection device for preventing an object from becoming soaked with a fluid.

SUMMARY OF THE DISCLOSURE

An embodiment of the disclosure meets the needs presented above by generally comprising a bag that has a top wall, a bottom wall, a first flap and a peripheral wall extending between the top wall and the bottom wall. The bottom wall may be positioned on a support surface and the bag may insertably receive an object when the first flap is positioned in an open position. The top wall is drawn upwardly and over the object such that the bag envelopes the object and the bag is comprised of a fluid impermeable material. A closure is attached to the bag and the closure closes the first flap. A plurality of first ties is coupled to the top wall. A plurality of second ties is coupled to the top wall and the second ties are tied to the first ties.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
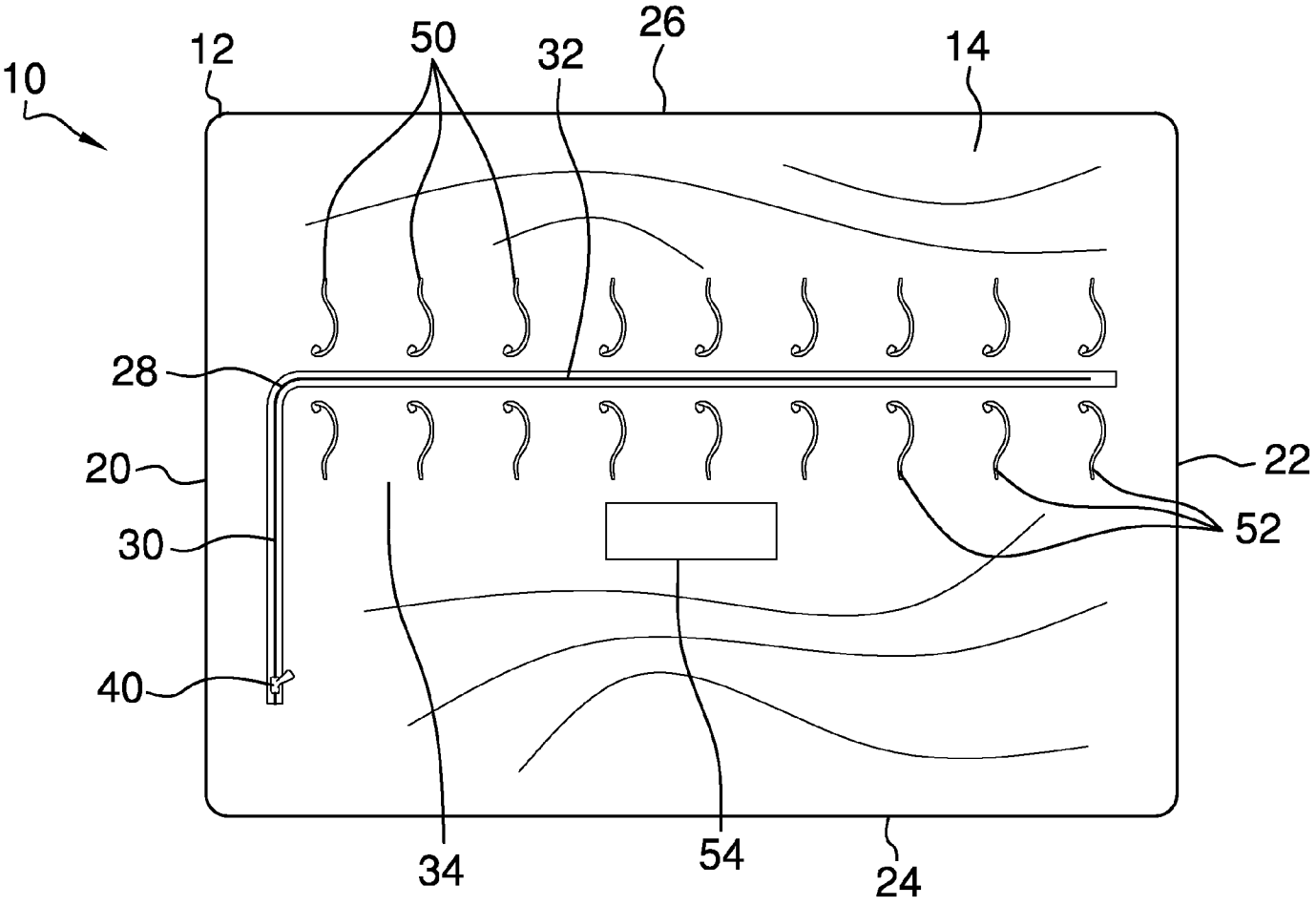
FIG. 1 is a top view of a fluid protection assembly according to an embodiment of the disclosure.
Figure 2:
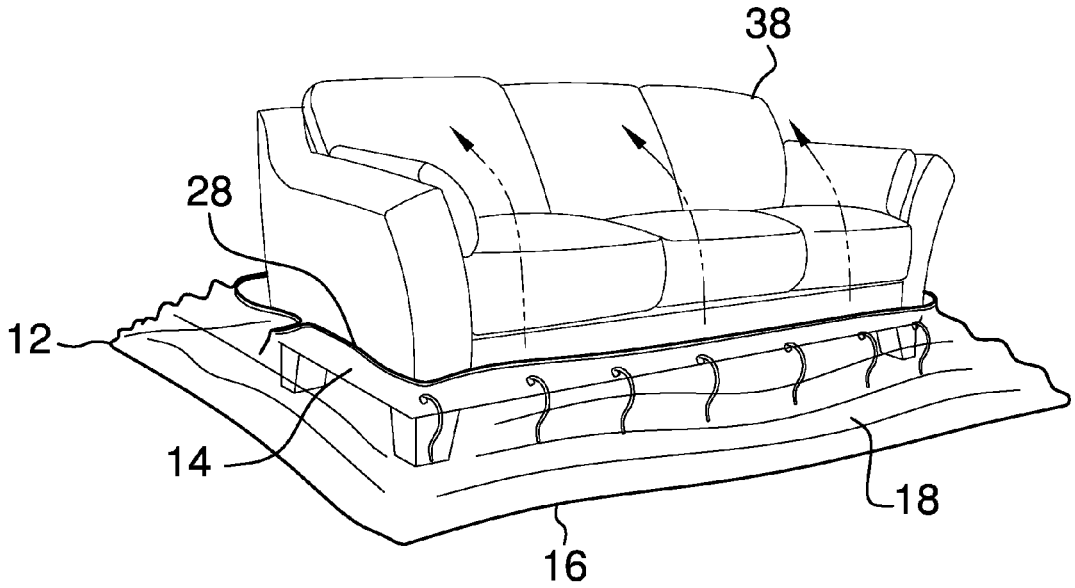
FIG. 2 is a front perspective in-use view of an embodiment of the disclosure.
Figure 3:
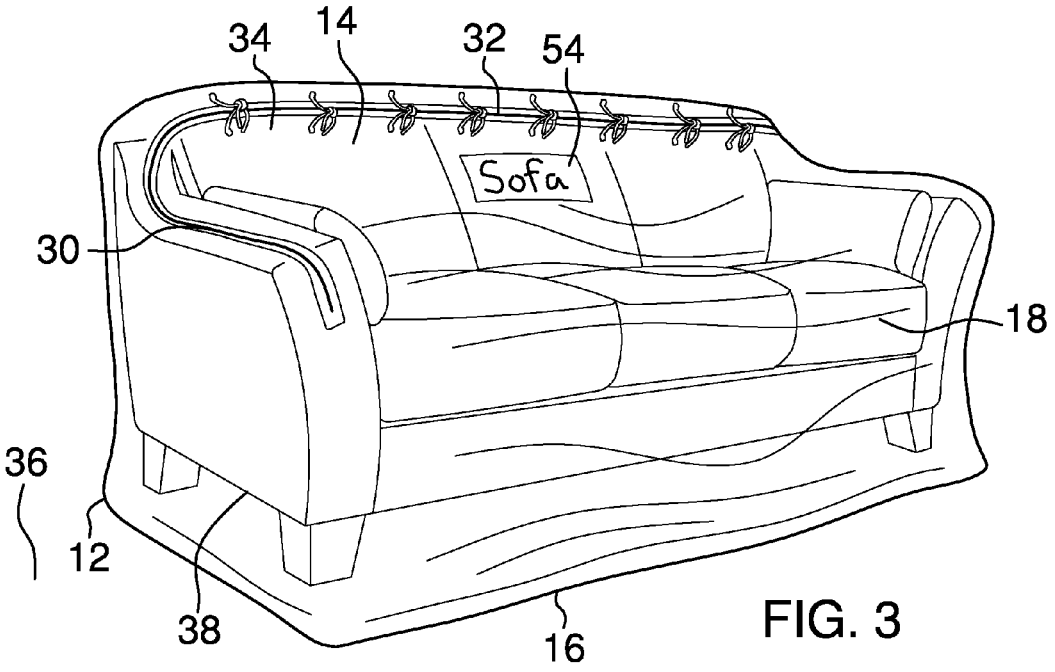
FIG. 3 is a perspective in-use view of an embodiment of the disclosure.
Figure 4:
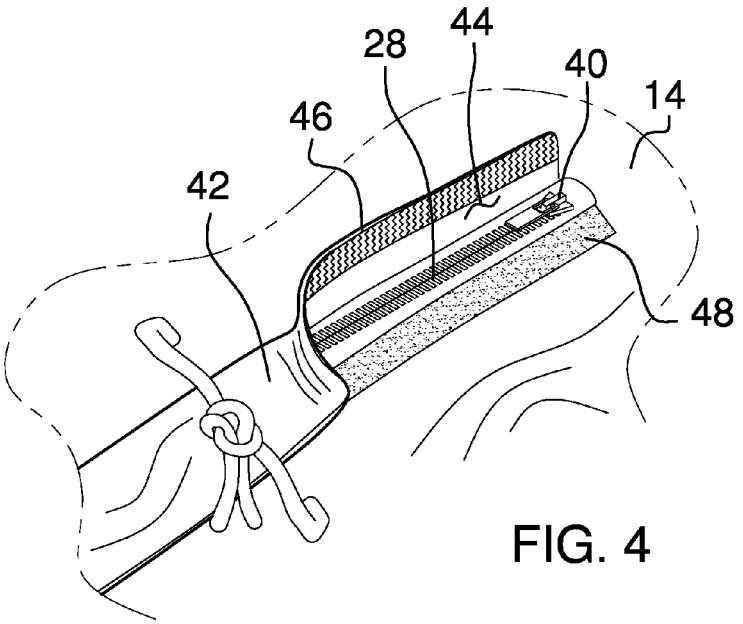
FIG. 4 is a top perspective view of a closure of an embodiment of the disclosure.

With reference now to the drawings, and in particular to FIGS. 1 through 5 thereof, a new protection device embodying the principles and concepts of an embodiment of the disclosure and generally designated by the reference numeral 10 will be described.

As best illustrated in FIGS. 1 through 5, the fluid protection assembly 10 generally comprises a bag 12 that has a top wall 14, a bottom wall 16 and a peripheral wall 18 extending between the top wall 14 and the bottom wall 16. The peripheral wall 18 has a first lateral side 20, a second lateral side 22, a front side 24 and a back side 26. The top wall 14 has a cut 28 extending therethrough and the cut 28 has a first portion 30 positioned adjacent to the first lateral side 20. The first portion 30 extends between the front side 24 and a point that is closure to the back side 26 than the front side 24. The cut 28 has a second portion 32 extending between the first portion 30 and the second lateral side 22. The second portion 32 is positioned closure to the back side 26 than the front side 24 and the second portion 32 forms a right angle with respect to the first portion 30 to define a first flap 34. The first flap 34 is positioned in an open position to access an interior of the bag 12 and the first flap 34 is positioned in a closed position to close the interior of the bag 12.

The bottom wall 16 may be positioned on a support surface 36 and the bag 12 may insertably receive an object 38 when the first flap 34 is positioned in the open position. The support surface 36 may be a floor or the like and the object 38 may be an article of furniture or other object that is susceptible to fluid damage. The top wall 14 is drawn upwardly and over the object 38 such that the bag 12 envelopes the object 38. The bag 12 is comprised of a fluid impermeable material such as poly vinyl chloride.

A closure 40 is attached to the bag and the closure 40 is coextensive with the first portion 30 and the second portion 32 of the cut 28. The closure 40 selectively closes the cut 28 and the closure 40 may be a zipper or the like. The closure 40 forms a fluid impermeable seal when the cut 28 is closed such that the closure 40 prevents fluid from contacting the object 38.

A second flap 42 is attached to the top wall 14 and the second flap 42 is positioned adjacent to the cut 28. The second flap 42 is coextensive with the first portion 30 and the second portion 32 of the cut 28. The second flap 42 has a mating surface 44 and the second flap 42 is positionable to cover the closure 40 having the mating surface 44 abutting the top wall 14. A first coupler 46 is attached to the second flap 42 and the first coupler 46 is coextensive with the second flap 42. The first coupler 46 is positioned on the mating surface 44. A second coupler 48 is attached to the top wall 48 and the second coupler 48 is positioned closure to the cut 28 than the front side 24 of the peripheral wall 18. The second coupler 48 is coextensive with the cut 28 and the second coupler 48 is complementary with the first coupler 46 such that the second flap 42 is retained to cover the closure 40. Each of the first 46 and second 48 couplers may be a hook and loop fastener.

A plurality of first ties 50 is coupled to the top wall 14 and the first ties 50 are spaced apart from each other and distributed along the second portion 32. The first ties 50 are positioned closure to the second portion 32 than the back side 26 of the peripheral wall 18. A plurality of second ties 52 is coupled to the top wall 14 and the second ties 52 are spaced apart from each other and distributed along the second portion 32. The second ties 52 are positioned closure to the second portion 32 than the front side 24 of the peripheral wall 18. Each of the second ties 52 is aligned with an associated one of the first ties 50 and each of the second ties 52 is tied to the associated first tie 50 when first flap 34 is positioned to cover the closure 40. The first ties 50 and the second ties 52 prevent the closure 40 from being exposed to a stretching force between the front side 24 and the back side 26.

Figure 5:
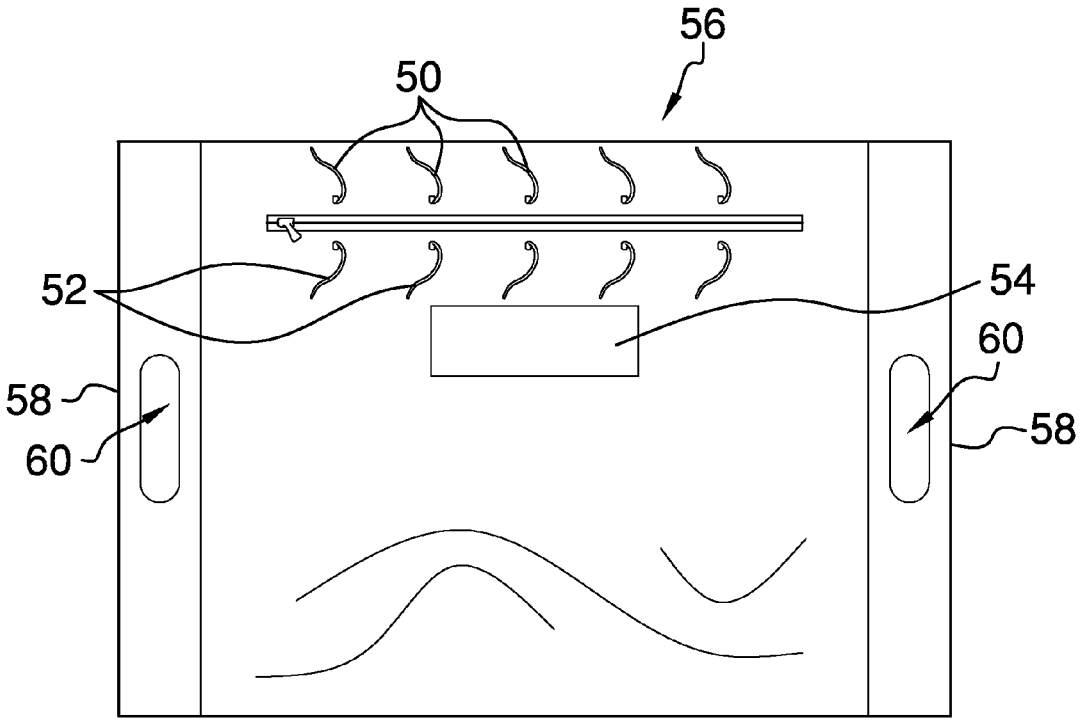
FIG. 5 is a top view of an alternative embodiment of the disclosure.

A panel 54 is coupled to the top wall 14 and the panel 54 is positioned closure to the second portion 32 than the front side 24. The panel 54 may be written upon to indentify the object 38 contained within the bag 12. In an alternative embodiment 56 as shown in FIG. 5, the cut 28 may be substantially coextensive with the back side 26 of the peripheral wall 18. A pair of handles 58 is each coextensively attached to an associated one of the first lateral side 20 and the second lateral side 22 of the peripheral wall 18. Each of the handles 58 has an opening 60 extending therethrough thereby facilitating each of the handles 58 to be gripped.

In use, the bottom wall 16 is placed on the support surface 36 and the first flap 34 is positioned in the open position. The object 38 is placed within the bag 12 and the top wall 14 is drawn upwardly and over the object 38. The closure 40 is closed and the first flap 34 is positioned to cover the closure 40. The second ties 52 are tied to the associated first ties 50 and the name of the object 38 is written on the panel 54. The object 38 is placed within the bag 12 in anticipation of the object 38 being exposed to fluid due to a natural disaster or other event involving the object 38 being exposed to fluid.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid protection assembly configured to protect an object from becoming soaked with a fluid, said assembly comprising:

a bag having a top wall, a bottom wall, and a peripheral wall extending between said top wall and said bottom wall, a cut extending through said top wall, said cut having a first portion and a second portion, said cut defining a first flap, said first flap being positioned in an open position to access an interior of said bag, said first flap being positioned in a closed position to close said interior of said bag, said bottom wall being configured to be positioned on a support surface, said bag being configured to insertably receive an object when said first flap is positioned in said open position, said top wall being configured to be drawn upwardly and over the object such that said bag envelopes the object, said bag being comprised of a fluid impermeable material;

a closure attached to said bag, said closure closing said cut;

a second flap attached to said top wall, said second flap being positioned adjacent to said cut, said second flap being coextensive with said first portion and said second portion of said cut, said second flap having a mating surface, said second flap being positionable to cover said closure having said mating surface abutting said top wall;

a plurality of first ties being coupled to said top wall, said first ties being spaced apart from each other, positioned proximate to said second portion, and distributed along said second portion; and a plurality of second ties being coupled to said top wall, said second ties being spaced apart from each other, positioned proximate to said second portion, and distributed along said second portion, each of said second ties being aligned with an associated one of said first ties across said second portion wherein each said second tie and associated first tie extend over and secure said second flap over said closure and inhibit stretching force from being applied to said second portion of said cut to resist inadvertent opening of said closure along said second portion.

2. The assembly according to claim 1, wherein said peripheral wall has a first lateral side, a second lateral side, a front side and a back side, said top wall having a cut extending therethrough.

3. The assembly according to claim 2, further comprising:

a panel coupled to said top wall, said panel being positioned closer to said second portion than said front side, said panel being configured to be written upon.

4. The assembly according to claim 2, wherein said a first portion of said cut is positioned adjacent to said first lateral side, said first portion extending between said front side and a point being closer to said back side than said front side.

5. The assembly according to claim 4, wherein said second portion of said cut extends between said first portion and said second lateral side, said second portion being positioned closer to said back side than said front side, said second portion forming a right angle with respect to said first portion to define said first flap.

6. The assembly according to claim 5, wherein said closure being coextensive with said first portion and said second portion of said cut, said closure forming a fluid impermeable seal when said cut is closed such that said closure is configured to prevent a fluid from contacting the object.

7. The assembly according to claim 1 further comprising a first coupler attached to said flap, said first coupler being coextensive with said flap, said first coupler being positioned on said mating surface.

8. The assembly according to claim 7, further comprising a second coupler attached to said top wall, said second coupler being positioned closure to said cut than said front side of said peripheral wall, said second coupler being coextensive with said cut, said second coupler being complementary with said first coupler such that said flap is retained to cover said closure.

9. The assembly according to claim 1, further comprising said first ties being positioned closer to said second portion than a back side of said peripheral wall.

10. The assembly according to claim 9, further comprising said second ties being positioned closer to said second portion than a front side of said peripheral wall, each of said second ties being tied to said associated first tie when said second flap is positioned to cover said closure.

11. A fluid protection assembly configured to protect an object from becoming soaked with a fluid, said assembly comprising:

a bag having a top wall, a bottom wall, and a peripheral wall extending between said top wall and said bottom wall, said peripheral wall having a first lateral side, a second lateral side, a front side and a back side, said top wall having a cut extending therethrough, said cut having a first portion positioned adjacent to said first lateral side, said first portion extending between said front side and a point being closer to said back side than said front side, said cut having a second portion extending between said first portion and said second lateral side, said second portion being positioned closer to said back side than said front side, said second portion forming a right angle with respect to said first portion to define a first flap, said first flap being positioned in an open position to access an interior of said bag, said first flap being positioned in a closed position to close said interior of said bag, said bottom wall being configured to be positioned on a support surface, said bag being configured to insertably receive an object when said first flap is positioned in said open position, said top wall being configured to be drawn upwardly and over the object such that said bag envelopes the object, said bag being comprised of a fluid impermeable material;

a closure attached to said bag, said closure being coextensive with said first portion and said second portion of said cut, said closure selectively closing said cut, said closure forming a fluid impermeable seal when said cut is closed such that said closure is configured to prevent a fluid from contacting the object;

a second flap attached to said top wall, said second flap being positioned adjacent to said cut, said second flap being coextensive with said first portion and said second portion of said cut, said second flap having a mating surface, said second flap being positionable to cover said closure having said mating surface abutting said top wall;

a first coupler attached to said second flap, said first coupler being coextensive with said second flap, said first coupler being positioned on said mating surface;

a second coupler attached to said top wall, said second coupler being positioned closure to said cut than said front side of said peripheral wall, said second coupler being coextensive with said cut, said second coupler being complementary with said first coupler such that said second flap is retained to cover said closure;

a plurality of first ties being coupled to said top wall, said first ties being spaced apart from each other, positioned proximate to said second portion, and distributed along said second portion, said first ties being positioned closer to said second portion than said back side of said peripheral wall;

a plurality of second ties being coupled to said top wall, said second ties being positioned closer to said second portion than said front side of said peripheral wall, said second ties being spaced apart from each other, positioned proximate to said second portion, and distributed along said second portion, each of said second ties being aligned with an associated one of said first ties across said second portion wherein each said second tie and associated first tie extend over and secure said second flap over said closure and inhibit stretching force from being applied to said second portion of said cut to resist inadvertent opening of said closure along said second portion; and a panel coupled to said top wall, said panel being positioned closure to said second portion than said front side, said panel being configured to be written upon.

* * * * *